United States Patent [19]

Sone et al.

[11] 3,953,651

[45] Apr. 27, 1976

[54] ACRYLIC SYNTHETIC FIBER HAVING ANIMAL HAIR-LIKE HAND

[75] Inventors: Masao Sone; Kojiro Arai; Katsuaki Nomura, all of Okayama, Japan

[73] Assignee: Japan Exlan Company Limited, Osaka, Japan

[22] Filed: Nov. 13, 1973

[21] Appl. No.: 415,398

[30] Foreign Application Priority Data

Nov. 14, 1972 Japan ..... 47-114135

[52] U.S. Cl. ..... 428/391; 57/140 R; 57/140 BY; 57/153; 428/394

[51] Int. Cl.[2] ..... B32B 27/02; B23B 27/30

[58] Field of Search ..... 117/138.8 UA, 139.5 A, 117/161 ZA; 57/140 BY, 140 R, 153; 428/391, 394

[56] References Cited

UNITED STATES PATENTS

| | | | |
|---|---|---|---|
| 3,366,584 | 1/1968 | Zimmerman | 260/4 |
| 3,434,874 | 3/1969 | Proffitt | 117/138.8 |
| 3,445,276 | 4/1969 | Pikula | 117/138.8 |
| 3,488,217 | 1/1970 | Ryan | 117/138.8 |
| 3,618,307 | 11/1971 | Jonkoff | 57/140 |
| 3,653,952 | 4/1972 | Gagliardi | 117/126 |
| 3,655,420 | 4/1972 | Tichenor | 117/138.8 |
| 3,716,547 | 2/1973 | Corey et al. | 260/29.6 |
| 3,766,115 | 10/1973 | Sands | 260/29.1 |
| 3,779,703 | 12/1973 | Tesoro | 8/115.5 |
| 3,791,998 | 2/1974 | Bruns | 260/2.5 |

*Primary Examiner*—P. E. Willis, Jr.
*Attorney, Agent, or Firm*—Wenderoth, Lind & Ponack

[57] ABSTRACT

Acrylic synthetic fibers having an interfiber entanglement coefficient of 10–40, an interfiber entangling force after hot-water treatment of not greater than 50 mg and a specific type of silicone resin deposited on the surfaces of the fibers.

2 Claims, 3 Drawing Figures

ACRYLIC SYNTHETIC FIBER HAVING ANIMAL HAIR-LIKE HAND

This invention relates to an acrylic synthetic fiber which is high in the washing durability and has an animal hair-like hand. More particularly, present invention relates to a novel acrylic synthetic fiber on whose surface a specific type of silicone resin is deposited and to which a permanent animal hair-like hand is imparted by maintaining the friction characteristics and interfiber entangling property in specific ranges.

Acrylic synthetic fibers have a hand closer to that of animal hairs, particularly wool fibers, than of other synthetic fibers and therefore have already been used extensively in wool fiber products, particularly intermediate wears, underwears and interior decorations. Although the hand of acrylic synthetic fibers, it is similar to that of wool fibers but is only recognized to be higher than other synthetic fibers such as, for example, polyamide fibers and polyester fibers, and is recognized in its absolute evaluation to be much different. Particularly the slippery touch peculiar to wool fibers is a property has not yet been imparted which any synthetic fiber. It has been strongly desired in the industry to establish a fiber modifying means for the object of providing such property.

However, no practical method of totally attaining such object on an industrial scale has yet been established and many problems remain to date.

However, it is true that some suggestions have already been made to impart a wool-like hand or particularly a slippery touch to acrylic synthetic fibers. For example, there is known a method of improving slippery touch by treating acrylic synthetic fibers with a polyhydric alcohol type nonionic surface active agent, specific cationic surface active agent or specific anionic surface active agent. However, there is a fundamental defect recognized in that the slippery touch imparted by such treating agent is so poor in durability as to be substantially lost in ordinary washing.

On the other hand, as a method of imparting a durable slippery touch to acrylic synthetic fibers, there is also suggested a method of treating surfaces with a silicone resin. For example, in Japanese Pat. No. 26436/1969, there is mentioned a method wherein a mixture of a silicone resin and polyepoxide is used as a fiber treating agent and, in U.S. Pat. No. 3,418,160, there is mentioned a method wherein a mixture of a silicone resin and lanolin is deposited on fiber surfaces.

However, according to such methods, the fibers are likely to bond and harden to each other, their hand becomes rough and hard, the polyepoxide or lanolin used reduces the slipperiness of the silicone resin and therefore no sufficient slippery touch will be provided.

Further, as another method, in each of Japanese Pat. Nos. 27520/1969 and 28733/1970, there is mentioned a method of improving the hand by depositing a higher ester of acrylic acid or methacrylic acid or a vinyl ester of a higher fatty acid on fiber surfaces. Although by this method some degree of slippery touch is provided, the slippery touch itself is different in quality from the slippery touch of such animal fibers as wool and it is difficult to impart a required hand improving effect to the final product.

Further, as defects common to these methods, the friction coefficient between the fibers is reduced by applying the fiber treating agent, and the reduction of the entangling property between the fibers thereby causes such troubles as rolling up on the carding machine and increase in waste fibers in the carding process, and frequent fiber breaks in the spinning process, and makes the industrial practice very difficult.

As well known, dimensional of fibers, particularly the number of crimps, crimp index, fineness and cross-sectional shape of the fiber, are highly correlated with the touch and hand of the final knit or woven fabrics. For example, in British Pat. No. 1,111,880, it is described to maintain in a fixed range a straightness factor defined as a function of the average curvature of crimps, number of crimps and fineness to improve the slippery hand and antipilling property of knit or woven fabrics. Such straightness factor is certainly important as a physical quantity quantitatively expressing the touch and hand of fiber materials forming knit or woven fabrics but the touch and hand and particularly slippery touch are not straightly determined only by such dimensional characteristics of sample fibers, but rather, such other factors as friction characteristics between fibers greatly contribute to them.

For such reasons, any conventional method of modifying acrylic synthetic fibers contains some functional defect as a method of providing a slippery touch very similar to that of wool fibers and a remarkable obstacle has been recognized in its industrial practice.

As a result of endeavors to solve problems of such conventional techniques, the present inventors have discovered the fact that the hand of acrylic synthetic fibers and knit or woven fabrics obtained from said fibers can be made very similar to the slippery touch of knit and woven fabrics of animal hairs by depositing a specific type of silicone resin on the surfaces of fibers and maintaining in fixed ranges the entanglement coefficient between fibers and entangling force between fibers after the hot-water treatment, as detailed below.

To explain more particularly, although it has been empirically known that the hand, or particularly the slippery touch of knit or woven fabrics, depends mostly on the friction characteristics of the fibers, the physical meaning of the slippery touch has so far hardly been theoretically elucidated. The present inventors have already established a means of quantitatively expressing the slippery touch in Japanese Pat. application No. 86210/1972 and have clarified that the slippery touch can be quantitatively expressed as a physical quantity depending on the friction characteristics between fabrics under the action of a high compression load.

From the results of the measurement by the present inventors, it has been found that the interfabric friction of a fabric knit of wool fibers, high in slippery touch, is recorded in a smooth wave form, comparatively small in irregularity, but that the interfabric friction of a fabric knit of acrylic synthetic fibers made in an ordinary manner, or acrylic synthetic fibers to which such known fiber treating agent as is mentioned above has been applied, is recorded in a serrated typical stick-slip wave form and shows a friction characteristic quite different from that of a fabric knit of wool fibers.

A main object of the present invention is to provide an acrylic synthetic fiber having an animal hair-like hand improved in washing durability.

Another object of the present invention is to provide a concrete means of producing acrylic synthetic fibers having a favorable slippery hand, causing no such problems such as rolling up in processing steps of spinning, and being high in processability.

Other objects of the present invention will become clear from the following description.

These objects of the present invention can be attained by providing an acrylic synthetic fiber in which the latter detailed interfiber entanglement coefficient is 10 to 40, the interfiber entangling force after hot water-treatment is not more than 50 mg. and a silicone resin defined by the structural formula (1)

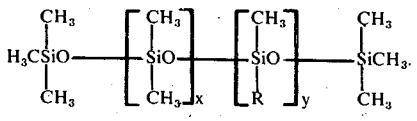

(1)

(Wherein R is $R'NH_2$, $R'NHR''$ or $R'NR''_2$, R' is $-(CH_2)_n-$, *n* is 1 to 3, R'' is $C_mH_{2m+1}$, *m* is 1 to 3, *x* and *y* are positive integers and the molecular weight of the silicone resin is not more than 100,000) is deposited on the surface thereof in an amount of 0.1 to 3.0 % based on the dry weight of the fiber.

The invention will be further explained by referring partly to the accompanying drawings wherein FIG. 1 is an explanatory view of a fabric friction measuring apparatus for measuring the stress reduction rate tan$\alpha$ at the time of kinetic friction and its recording sheet.

Figure 1:
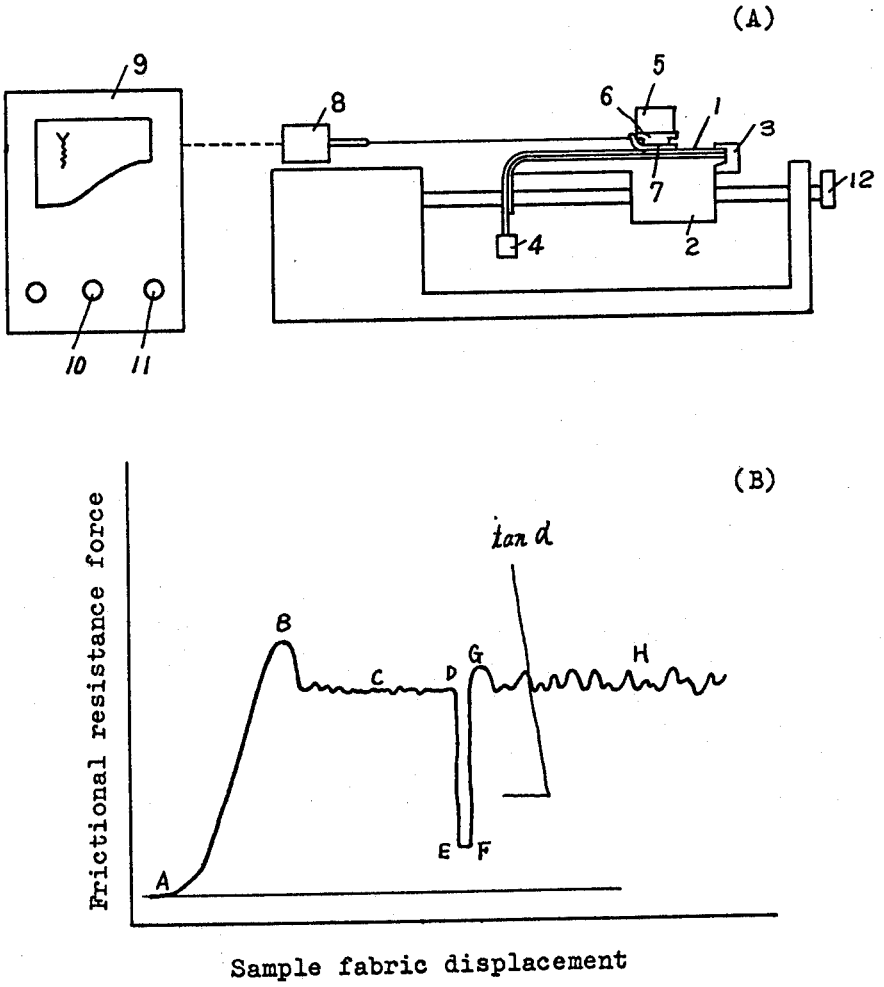

In the acrylic synthetic fiber according to this invention, as it has a fixed interfiber entangling property, such troubles as rolling up on the carding machine, increase of waste fibers and fiber breaks in the spinning step are totally eliminated, an excellent processability is obtained, sharp crimped wave forms imparting a harsh hand to the final product vanish and the interfiber entangling force after the hot water-treatment is reduced.

That is to say, the present invention contributes to the industry by providing a novel acrylic synthetic fiber in which a favorable slippery hand very similar to that of knit and woven fabrics made of animal hair fibers is imparted to knit and woven fabrics made by using acrylic synthetic fibers. This is made possible as a result of the combined effect of the interfiber entangling force and the selection of the specific silicone resin defined by the structural formula (1), and further, the level of the slippery touch of the final product is hardly reduced by ordinary domestic washing.

Further, as a secondary effect of the present invention, it can be stated that, in knitting spun yarns made of such acrylic synthetic fibers, it is not necessary at all to apply a knitting oil agent and the process can be remarkably simplified.

The acrylic synthetic fiber on which the specific silicone resin specific silicone resin generally a fiber consisting of a polymer or copolymer in which acrylonitrile is the main component of the fiber-forming polymer, and is fiber consisting of a polyacrylonitrile, a copolymer of not less than 70 parts of acrylonitrile and the remainder another vinylic monomer copolymerizable with acrylonitrile, or a mixed polymer of such copolymer and another copolymer.

No specific limitation is recognized in the polymerizing process for producing such copolymer. Any polymerizing process used for producing an acrylonitrile polymer such as the known solution polymerization or aqueous suspension polymerization can be used.

Such polymer containing acrylonitrile as a main component is dissolved in a known organic solvent or inorganic solent to form a spinning solution, the spinning solution is spun singly or compositely to form fiber filaments, and the fiber filaments are water-washed and stretched in an ordinary manner; the silicone resin defined by the structural formula (1) is deposited on the fiber filaments in an amount of 0.1 to 3.0 %. or more preferably 0.5 to 2.0 %, by weight based on the dry weight of the fibers, without being mixed with any other resin, and the fiber filaments are then collapsed, heat-relaxed and mechanically crimped to form the final fibers. However, it does not deviate at all from the present invention to secondarily dry the mechanically crimped acrylic synthetic fibers as required.

Further, the amount of silicone resin deposited on the surfaces of the treated fibers is not strictly limited. It is also possible to deposit it on a tow or staple after being heat-relaxed or secondarily dried.

In order to deposit such silicone resin on the surfaces of fibers, there can be adopted a process wherein an acrylic synthetic fiber is dipped for not less than 0.5 second in an aqueous emulsion, maintaining a liquor ratio of 1 : 100 or more, prepared by adding an emulsifier, for example, a nonionic surface active agent composition POE (n) alkylphenyl phosphate (wherein n is the polymerization degree of the polyoxyethylene amd is a positive integer of 5 to 15) to the silicone resin.

For dipping the fibers in such aqueous emulsion, usually a continuous treating system is adopted but, as another manner, a batch system can be used.

After the acrylic synthetic fibers have been dipped in the aqueous emulsion the excess emulsion is squeezed out with a roller device to adjust the amount of the silicone resin deposited on the fiber surfaces, and are then dried. For the drying temperature, in order to orient and secure the silicone resin on the surface of the treated fibers, it is preferable to adopt a temperature range of 70° to 150°C. or more preferably 100° to 130°C. This drying treatment may be carried out simultaneously with the drying step for collapsing the fiber structure.

When the amount of the silicone resin deposited on the fibers is less than 0.1 %, it will be difficult to orient and secure the silicone resin on the fiber surfaces and no favorable slippery touch will be imparted to the fibers.

When the silicone resin in excess of 3.0 % is deposited on the fibers, the fibers will bond and harden together and will have a harsh hand and, in addition, the operability of the spinning step will be remarkably reduced. Therefore, this is not desirable.

The amount of the silicone resin can be maintained in the above mentioned range by adjusting the concentration of the treating bath, dipping time and squeezing condition.

In working the present invention, the acrylic synthetic fibers on which the proper amount of the silicone resin has been deposited have a slightly reduced level of the entangling property between fibers by reducing the friction coefficient and thermosetability of the crimp to lower than those of the acrylic synthetic fibers on which the silicone resin is not deposited. In order that such troubles in processing as, for example, rolling up, fly and increase of waste fibers in the carding step, and the frequent yarn breaks and increase of fiber irregularities, do not occur in the subsequent spinning step or the like, it is necessary that the interfiber entanglement coefficient be in the range of 10 to 40.

When the interfiber entanglement coefficient is less than 10, the above described rolling up, fly and waste in the carding step and yarn breaks in the spinning step will increase so remarkably that no economic operation will be maintained.

Further, when the interfiber entanglement coefficient exceeds 40, neps will be increased, the uniformity of the spun yarn will be reduced and, in the extreme case, the formation of the spun yarn will become impossible.

Generally, as a means of increasing the interfiber entanglement coefficient, there can be a method used wherein the number of crimps or crimp index is increased. However, in order to increase the slippery touch of the final product by the combined effect of the interfiber entanglement coefficient and treatment with the silicone resin represented by the structural formula (1), it is not always desirable to increase the number of crimps and the crimp index without any limitation.

In this sense, as a more preferable manner of working the present invention, there is recommended a method wherein a spinning oil which will increase the friction coefficient between fibers, for example, an ethylene oxide added higher alcoholic nonionic active agent, is applied to the dried fibers to be treated. The treating agent of this kind is recognized to have a practical advantage in the respect that it easily drops in such warm or hot water-treatment as, for example, in a dyeing step, and has no influence on the hand of the product.

As another preferable working manner, there is a method wherein the treated fibers which have been heat-relaxed at a temperature higher than the mechanical crimping temperature and dried are mechanically crimped at 80° to 105°C. in wet heat or 100° to 150°C. in dry heat so that non-thermosetting crimps having a proper interfiber entanglement coefficient and partly vanishing in the hot water-treatment may be imparted to the fibers.

In the yarns or knit or woven fabrics made by using the acrylic synthetic fibers proposed in the present invention, the weaker the interfiber entangling force of the yarns or knit or woven fabrics, the more noticeable the slippery touch caused by the deposited silicone resin. In this sense, it is necessary to maintain the interfiber entangling force, after applying such hot water-treatment as dyeing, at less than 50 mg., or more preferably less than 30 mg.

When the interfiber entangling force after the hot water-treatment exceeds 50 mg., the slippery touch will be impaired and a harsh touch will result. Therefore, this is not desirable. As a method of reducing the interfiber entangling force, there is a method wherein the number of crimps and crimp index are reduced, a method wherein the moment of inertia of the fiber area is reduced, a method wherein the monofilament fineness in deniers is reduced or a method wherein the modulus of elasticity in the axial direction of the fiber is reduced.

The thus obtained acrylic synthetic fibers are usually mix-spun with highly shrinkable acrylic synthetic fibers having a latent shrinkability to form yarns or knit or woven fabrics. Said acrylic synthetic fibers may be used alone or as mix-spun with any other fibers. Particularly, when they are mix-spun with such animal hair fibers as wool, knit or woven fabrics having a very favorable touch and hand will be obtained, partially due to the slippery touch of the animal hair fibers.

The definitions and measuring methods of the physical quantities expressing the slippery touch of the fibers shall be detailed in the following.

1. Silicone resin deposition rate:

Several kinds of organic solvent phases, in which the concentration of the silicone resin to be deposited on the sample fibers is varied, are first prepared and intensities of the infrared absorption at 800 $cm^{-1}$ of these organic solvent phases are determined with the infrared spectro-photometer Model 521 (manufactured by Perkin Elmer Co.), and then a calibration line showing a relation between the amount of the silicone resin and the intensity of the infrared absorption of the groups $Si\text{-}CH_3$ and $Si—(CH_3)_2$ at 800 $cm^{-1}$ is determined.

Then the acrylic fibers to be tested are cut to a length of 0.1 to 0.3 mm., 3 mg. of them are mixed with 200 mg. of potassium bromide and the mixture is further mixed and ground in an ordinary manner and is then molded into tablets (sample A). Further, tablets of acrylic fibers having no silicone resin deposited on them are made in the same manner (sample B).

Then, the sample A is placed on the sample side and the sample B on the compensating side of the infrared spectrophotometer Model 521 and the intensity of the infrared absorption at 800 $cm^{-1}$ is measured. The amount of the silicone resin deposited on the sample A is obtained from the intensity thus measured and the calibration line determined previously.

2. Stress reductiion rate tan$\alpha$ at the time of kinetic friction:

The kinetic frictional force between sample fabrics is determined as magnified and measured by using a fabric friction measuring apparatus shown in FIG. 1 (A). To explain more particularly by also using FIG. 1 (B), in an adjusted humidity atmosphere at 20°C. and a relative humidity of 65 %, a sample fabric 1 is mounted on a sample stand 2, is fixed at one end with a sample presser and has a load 4 to 30 g. act at the other end to maintain tension thereon. A slider 6 of an effective contact surface of 3 $cm^2$. (2 cm. × 1.5 cm.) on which a compressive load 5 of 450 g. is made to act is mounted on said sample fabric 1. A sample fabric piece 7 is fixed on the lower surface of said slider 6. The sample stand 2 is moved at a constant velocity of 12 mm./min. and the frictional force generated between the sample fabrics is detected with a resistance wire strain meter 8 connected with the slider 6 and is recorded in a recorder 9. In the measurement, when the kinetic frictional force shows a constant state, the indicator of the recorder is shifted to zeropoint and then, as shown at the points F and G, the detecting sensitivity is magnified to 5 to 10 times as large and the minute variation of the kinetic frictional force is magnified and measured.

The stress reduction rate tan$\alpha$ at the time of the kinetic friction is a stress reduction rate per mm. of the displacement of the sample fabric in the magnified measurement view and is expressed as an average value of a total of 100 tan$\alpha$ values obtained from 5 on a set of 20 samples. When the tan$\alpha$ is not more than 25 g./mm., the sample fibers have a favorable slippery touch very similar to that of animal hair fibers.

Figure 2:
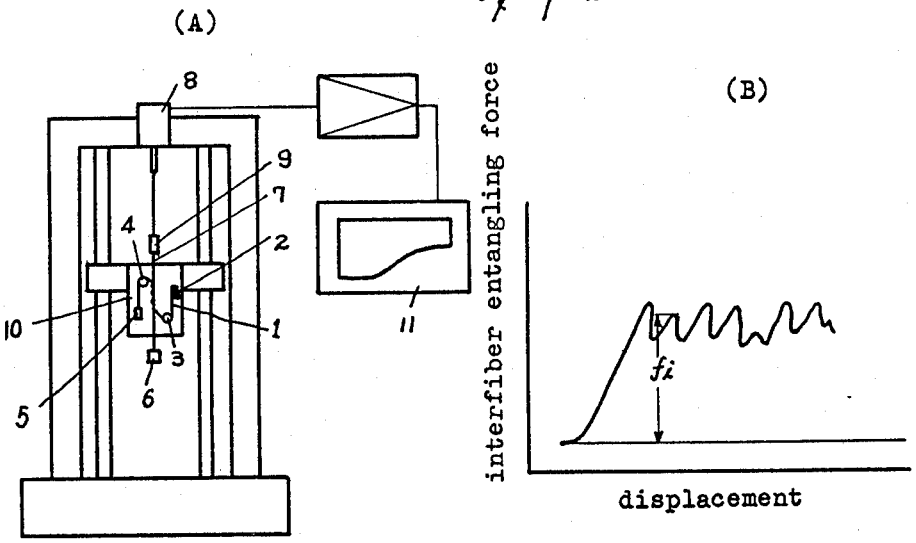
FIG. 2 is an explanatory view of a fiber friction measuring apparatus for measuring the interfiber entanglement coefficient and the interfiber entangling force after the hot water-treatment and their recording sheets.

3. Interfiber entanglement coefficient ($f/\sqrt{D}$):

The degree of the entanglement between two twisted fibers is measured by using the measuring apparatus shown in FIG. 2. To explain more particularly with reference to the drawing, a sample fiber 1 is fixed at one end to a chuck 2 and the monofilament is led along the outer peripheries of guide rollers 3 and 4 and is suspended by means of a weight 5 of 2 mg. acting at the lower end. Then another sample fiber 7 having a weight 6 of 2 mg. fixed at one end is held at the other end with a chuck 9 connected with a resistance wire strain meter 8. Then the monofilaments 1 and 7 are twisted together 5 times and are suspended. Then a moving stand 10 fitted with the guide rollers 3 and 4 is moved downward, the generated stress is detected with the resistance wire strain meter 8 and is recorded in the recorder 11.

As shown in FIG. 2 (B), the height fi of the peak of the interfiber entangling force $f$ (in mg.) of a single sample is measured 20 times, then the sample is replaced, said height fi is measured repeatedly 10 times in the same manner as is mentioned above and the interfiber entangling force $f$ (in mg.) is determined as an average value of a total of 200 heights $f$i.

The interfiber entanglement coefficient $f/\sqrt{D}$ can be determined by dividing the thus obtained interfiber entangling force $f$ (in mg.) by the square root of the average monofilament fineness D (in deniers) of 20 sample fibers as determined in advance with a Denieroscope manufactured by Kyokko Seiko Co.

4. Interfiber entangling force $f_B$ after the hot water-treatment:

Asample fiber formed to have the upper end as a fixed end and the lower end as a free end is left dipped in water at 98°C. for 15 minutes, then the water temperature is reduced to below 60°C. and the sample fiber is taken out and is dried as fixed at the upper end in a hot air dryer at 80°C. for 30 minutes. By using this fiber, in the same measuring manner as in the interfiber entanglement coefficient, the interfiber entangling force $f_B$ after the hot water-treatment can be determined.

Examples of the present invention are mentioned in the following. However, the scope of the present invention is not limited thereby. In these examples, the parts and percentages are all by weight unless otherwise specified.

EXAMPLE 1

A copolymer made by copolymerizing 9.8 % methyl acrylate and 0.2 % sodium methallylsulfonate with 90 % acrylonitrile was dissolved in an aqueous solution of sodium thiocyanate, the obtained spinning solution was wet-spun into cold water and the obtained fibers were water-washed and stretched in an ordinary manner to prepare a swollen gel fiber tow of a water content of 80 %. This fiber tow was dipped for 3 seconds in an emulsion prepared by emulsifying and dispersing 2 % of a silicone resin of the structural formula (1) wherein R is $CH_2NH_2$, 1 % POE (9) nonylphenyl phosphate and 0.2 % of a catalyst Sumitex Accelerator SX-70A(produced by Sumitomo Chemical Co.), was then squeezed so that the amount of the emulsion deposited on the fibers was 80% based on the dry weight of the fibers and was then dried for 15 minutes in an atmosphere of a dry-bulb temperature of 125°C. and a wet-bulb temperature of 60°C. so that the voids in the fiber structure collapse and at the same time the silicone resin be oriented and fixed to the treated acryl fibers. Then, the fiber tow was further heat-relaxed for 8 minutes in compressed steam at 130°C. so as to relax the fiber structure, and was then fed into a stuffing box so as to be crimped; 0.33 % of Nissan Unilube 50 MB – 168 (produced by Nippon Oils and Fats Co.) as a spinning oil was deposited on the tow, which was then dried and cut to unequal lengths in a range of 60 mm – 140 mm. to prepare nonshrinkable acrylic synthetic fibers of a monofilament fineness of 2.5 deniers. The silicone resin deposition rate of these fibers was 0.97 %, the interfiber entanglement coefficient was 13.7 and the interfiber entangling force after the hot water-treatment was 12.0 mg. Then 60 % of these acrylic synthetic fibers and 40% of highly shrinkable acrylic synthetic fibers made by 40 turbostapler system and having a latent shrinkability of 12.4 % were mix-spun to make a two folded yarn of 52 yarn counts (metric yarn counts).

The obtained mix-spun yarn was skein-dyed and, at the same time, the latent shrinkability was developed to impart a bulkiness to the yarn. Two such spun yarns were plyed, were fed into a weft knitting machine of 14G, were knitted into a plain knit fabric, were then stretched by 4 % in the longitudinal direction and were set by Hoffmanset. (Knit fabric 1).

Then a knit fabric of a plain knit structure was made under the same conditions as above mentioned except that nonshrinkable acrylic synthetic fibers which had not been subjected to the emulsion-treatment recommended in the present invention and on which only a cationic softening agent Zontes TA 460 – 15 (produced by Matsumoto Oils and Fats Co.) had been deposited were used. (Knit fabric 2).

The results of measuring the stress reduction rates tan$\alpha$ at the time of kinetic friction and the sensory evaluation before and after the washing of these knit fabrics are shown in Table 1. It will be understood that the knit fabric 1 satisfying all the conditions proposed in the present invention, retains a favorable slippery touch even after the washing. By the way, as a washing method, there was adopted a method wherein the fabrics were washed for 15 minutes at a liquor ratio of 1 : 50 in warm water at 40°C. to which 1 g./l. of Monogen Uni had been added, using a domestic electric washing machine, and were then water-washed and dried at room temperature on a flat plate.

Table 1

| | | After the washing | |
|---|---|---|---|
| | Tan$\alpha$ | Tan$\alpha$ | Sensory evaluation |
| fabric 1 | 20.3 | 19.7 | Favorable slippery touch |
| fabric 2 | 20.5 | Over 100 | Scroppy touch |

EXAMPLE 2

The same spinning solution as in Example 1 was wet-spun into cold water to prepare acrylic synthetic fiber tows of a monofilament fineness of 3 deniers. Said fiber tows were refined. Then, as shown in Table 2, there were deposited a known commercial cationic softening agent on each of the samples 1 and 2 and several kinds of silicone resins defined by the structural formula (1) on the samples 3, 4, 5 and 8 at different deposition rates. They were dried, were then fed into a stuffing box so as to be mechanically crimped, were secondarily dried and were then cut to be of a fixed length of 57 mm. to make nonshrinkable acrylic synthetic fiber staples. 0.30 % of Nissan Unilube 50 MB – 168 was deposited on each of the samples 3 to 8 prior to mechanical crimping.

These sample fibers were spun according to a Shirley Miniature Spinning Frame to form two folded yarns of 36 yarn counts (metric yarn counts), were then skein dyed and were knitted into knit fabrics of plain knit structures of 12 gauges.

Separately, as controls, acrylic synthetic fiber tows of sample Nos. 6 and 7, on each of which a silicone resin in which R in the structural formula is

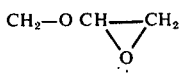

was deposited instead of the silicone resin defined by the structural formula (1), were prepared, were made into two folded yarns of 36 yarn counts (metric yarn counts) under the same process conditions as in this Example and were knitted into knit fabrics of plain knit structures of 12 gauges.

The interfiber entanglement coefficients, interfiber entangling forces after the hot water-treatment and tan$\alpha$ after the washing of these fibers and knit fabrics are also set forth in Table 2.

Table 2

| Sample No. | Softening agent | Amount of deposition in % | R in the structural formula (1) | $f/\sqrt{D}$ | $f_B$ | Tan$\alpha$ after the washing |
|---|---|---|---|---|---|---|
| 1 | Cationic softening agent | 0.5 | | 14.2 | 33.0 | Over 100 |
| 2 | " | 0.8 | | 13.7 | 33.0 | Over 100 |
| 3 | Silicone | 0.5 | $-CH_2NH_2$ | 16.1 | 16.6 | 21.8 |
| 4 | " | 0.9 | " | 13.8 | 14.0 | 19.5 |
| 5 | " | 1.6 | " | 14.2 | 11.3 | 15.6 |
| 6 | " | 0.8 | $CH_2-CH-CH_2$ (O) | 13.3 | 18.8 | 30.0 |
| 7 | " | 0.8 | $CH_2-CH-CH_2$ (O) | 15.1 | 20.4 | 34.3 |
| 8 | " | 0.8 | $CH_2NH_2$ | 13.0 | 15.7 | 21.5 |

Figure 3:
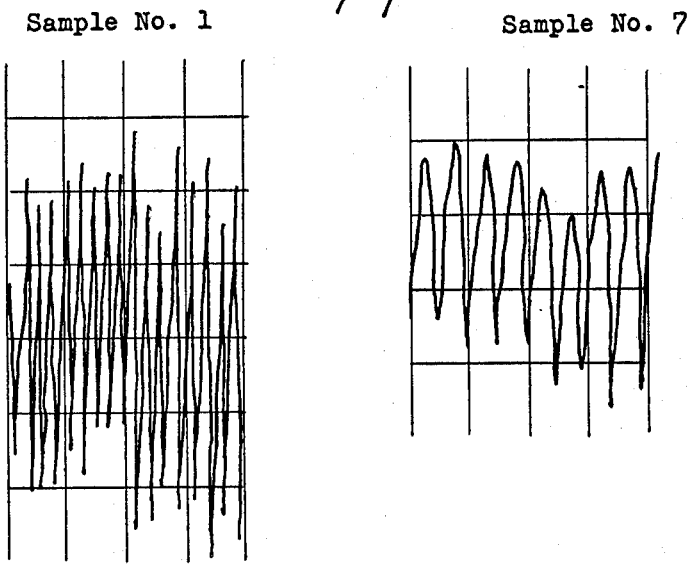
FIG. 3 shows recording sheets for the stress reduction rates tan$\alpha$ at the time of kinetic friction of the sample fibers mentioned in Example 2.
Figure 3:
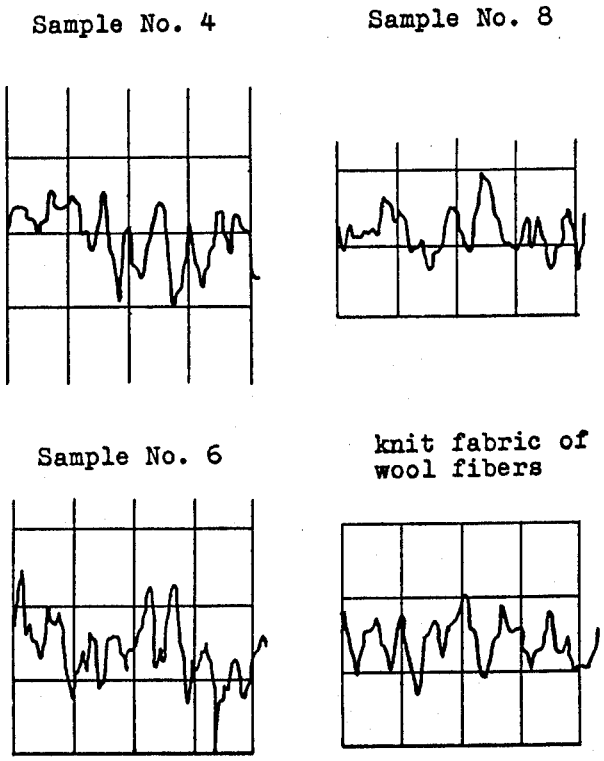

The fabric friction wave forms of the sample fibers shown in this Example are exemplified in FIG. 3. It will be understood from Table 2 and FIG. 3 that the friction characteristics of the samples 3, 4, 5 and 8, satisfying all the conditions proposed in the present invention, are very similar to the slippery touch of wool fibers. Further, aside from the quantitative evaluation mentioned in Table 1, the slippery touch was sensorily evaluated. Even from these results, it was confirmed that each of the samples 3, 4, 5 and 8 had a favorable slippery touch.

By the way, another sample acrylic synthetic fiber, as a control in which the concentration of the silicone in the emulsion was increased, the squeezing rate after the emulsion dipping treatment was reduced and the amount of deposition of the silicone resin deposited on the sample was adjusted to 3.9 %, rolled up so frequently due to sticking in the carding step in spinning that no satisfactory spun yarn could be prepared therefrom.

EXAMPLE 3

Two kinds of spinning solutions were prepared by dissolving copolymer A consisting of 90 % acrylonitrile, 9.8 % methyl acrylate and 0.2 % sodium methallylsulfonate, and another copolymer B consisting of 89 % acrylonitrile and 11 % vinyl acetate, respectively in aqueous solutions of sodium thiocyanate and were compositely wet-spun into cold water. The thus spun composite fibers were water-washed, stretched and collapsed in an ordinary manner, were than heat-relaxed for 8 minutes in compressed steam at 115°C., were then continuously dipped for 1 second in an emulsion prepared by emulsifying and dispersing 2 % of a silicone resin in which R in the structural formula (1) is $CH_2 - NH_2$ and 1 % POE (9) nonylphenyl phosphate, were mechanically crimped, treated with a spinning oil, dried and cut to make acrylic composite fiber staples of a monofilament fineness of 2.5 deniers. The silicone resin deposition rate on the sample fibers was 0.84 %, the interfiber entanglement coefficient was 24.6 and the interfiber entangling force after the hot water-treatment was recorded as 35.6 mg.

50 % of said sample fibers and 50 % of nonshrinkable acrylic synthetic fibers on which 0.97 % silicone resin had been deposited in Example 1 were mix-spun in an ordinary manner to make a two folded yarn of 72 yarn counts (metric yarn counts).

In making such spun yarn, such trouble as the rolling up on the card was not recognized at all. Further, tan$\alpha$ after the washing a knit fabric of a plain knit structure of these mix-spun yarns after being dyed was recorded as 20.9 g.mm. It was confirmed that the knit fabric retained a g./mm. slippery touch.

EXAMPLE 4

Acrylic synthetic fiber staples were made under the same conditions as in Example 1 except that acrylic synthetic fiber tows on which 0.97 % silicone resin mentioned in Example 1 had been deposited were fed into a stuffing box and the interfiber entanglement coefficient was adjusted to 8.3 by reducing the stuffing pressure. When the thus obtained fibers alone were spun, they rolled up in the carding step and the webs broke so frequently that it was impossible to continue the processing.

What we claim is:

1. An acrylic synthetic fiber in which the interfiber entanglement coefficient is from 10 to 40 and the interfiber entangling force after hot water-treatment is not more than 50 mg., said fiber having a silicone resin of the formula

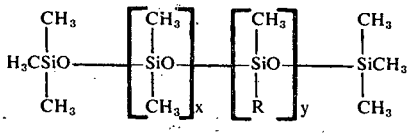

wherein R is $R'NH_2$, $R'NHR''$ or $R'NR''_2$, R' is $-(CH_2)_n-$, *n* is 1 to 3, R'' is $C_mH_{2m+1}$, *m* is 1 to 3, *x* and *y* are positive integers and the molecular weight of the silicone resin is not more than 100,000 deposited on the fiber surface in an amount of 0.1 to 3.0% based on the dry weight of the fiber.

2. An acrylic synthetic fiber according to claim 1, wherein the silicone resin is applied to the fiber in the form of an aqueous emulsion containing an emulsifier selected from the group consisting of polyoxyethylene(n)alkylphenyl phosphates wherein n is the polymerization degree of polyoxyethylene and is an integer of from 5 to 15.

* * * * *